US005505791A

United States Patent [19]

Tahara et al.

[11] Patent Number: 5,505,791

[45] Date of Patent: Apr. 9, 1996

[54] PROCESS OF PRODUCING NITRIDED AND HARDENED NICKEL ALLOY PRODUCTS

[75] Inventors: Masaaki Tahara; Haruo Senbokuya; Kenzo Kitano; Tadashi Hayashida; Teruo Minato, all of Osaka, Japan

[73] Assignee: Daidousanso Co., Ltd., Osaka, Japan

[21] Appl. No.: 429,841

[22] Filed: Apr. 27, 1995

Related U.S. Application Data

[62] Division of Ser. No. 907,567, Jul. 2, 1992, Pat. No. 5,445, 683.

[30] Foreign Application Priority Data

May 13, 1992 [JP] Japan ..... 4-120345

[51] Int. Cl.[6] ..... C23C 8/24

[52] U.S. Cl. ..... 148/217; 148/221; 148/238

[58] Field of Search ..... 148/217, 221, 148/238

[56] References Cited

U.S. PATENT DOCUMENTS

| | | | |
|---|---|---|---|
| 4,588,450 | 5/1986 | Purohit | 148/238 |
| 5,114,500 | 5/1992 | Tahara et al. | 148/238 |
| 5,403,409 | 4/1995 | Tahara et al. | 148/318 |

*Primary Examiner*—Deborah Yee

*Attorney, Agent, or Firm*—Armstrong, Westerman Hattori, McLeland & Naughton

[57] ABSTRACT

The present invention relates to nickel alloy products with their surfaces nitrided and hardened which are formed by pressure casting nickel alloy material, and nitrided and hardened layers are formed in surface layers. Since the nitrided and hardened surfaces of the nickel alloy products according to the invention have much better corrosion resistance than iron products have, anticorrosion treatment such as plating is not required, and rich lubricity and excellent tightening property can be obtained without having seizure and scuffing phenomena.

16 Claims, 3 Drawing Sheets

PROCESS OF PRODUCING NITRIDED AND HARDENED NICKEL ALLOY PRODUCTS

This is a division, of application Ser. No. 07/907,567 filed Jul. 2, 1992, now U.S. Pat. No. 5,445,683.

FIELD OF THE INVENTION

This invention relates to nickel alloy products formed by pressure casting with their surfaces nitrided and hardened, which have both mechanical strength and high corrosion resistance.

BACKGROUND OF THE INVENTION

Commonly used fasteners, such as tapping screws, bolts, nuts, washers, rivets, plugs, screws, and screw parts are typically made of structural carbon steel. They are produced by applying neutral-or carbo-quenching, thermal refining, and then anticorrosion treatment. Alternatively stainless steel products other than the above-mentioned carbon steel ones can be used for corrosion resistance. Although the market for stainless steel products is small because their cost performance and strength are inferior to those of carbon steel, the market is still expanding steadily.

Under such circumstances both the properties of corrosion resistance and mechanical strength tend to be demanded at the same time. For this reason, product such as screws, for example, of 18-8-stainless steel material which have been nitrided and hardened so as to improve deficient strength and scuffing resistance which are conventional weak points, and the like have appeared. However, the nitrided stainless steel products have some disadvantages such as corrosion of the nitrided surface in a short period. On the other hand, products such as bolts made of nickel alloy are generally used as high corrosion resistant material better than SUS in a field such as petrochemical plants.

However, just as SUS, the nickel alloy material has a low heat conductivity, which is one third of that of irons, and has problems that seizure, and scuffing phenomena (a state that seizure caused combination of parts) tend to occur. It also has a problem of inferior tightening property because the coefficient of skill friction is high and improvement of hardness by quenching is impossible. Nickel alloy material employed as material which is hard is generally carburized and nitrided, but cementation-hardening by elements such as carbon and nitrogen is difficult which is easy with iron material.

Accordingly, it is an object of the invention to provide nickel alloy products with their surfaces nitrided and hardened which have both high mechanical strength and scuffing resistance.

SUMMARY OF THE INVENTION

In accordance with the invention, the above object can be accomplished by providing nickel alloy products formed by pressure casting nickel alloy material, wherein nitrided and hardened layers are formed in the surfaces.

DETAILED DESCRIPTION OF THE INVENTION

Nickel alloy products with their surfaces nitrided and hardened according to the invention can be obtained by maintaining nickel alloy products in a fluorine- or fluoride-containing gas atmosphere with heating, and holding the fluorinated nickel alloy ill a nitriding atmosphere with heating to form surface layers of the nickel alloy material into nitriding layers.

As nickel alloy material of the above-mentioned nickel alloy products, nickel alloys containing more than 25 weight % (cited herein as " %") nickel, for example, Ni-Cr, Ni-Cr-Mo, Ni-Cr-Fe, Ni-Cr-Co and the like are mainly used in the invention. Examples of such alloys with a high nickel content are inconel, hastelloy, and incolloy. Nickel alloys containing not more than 25% nickel can be also used in the invention. Therefore, in the invention, the term "nickel alloy" includes both alloys containing more than 25% nickel and not more than 25% nickel. However, alloy containing more than 25% nickel and not more than 50% iron is more suitable. To be more concrete, bolts, rivets, screws, nuts, pipe thread plugs, washers, pins, inserts, turnbuckles, shackles, pipe swagelocks, and the like are included in nickel alloy products, and shapes of nickel alloy products are not specified in this invention.

Fluorine- or fluoride-containing gas for a fluorine- or fluoride-containing gas atmosphere, in which the above-mentioned nickel alloy products react, is fluorine compound gas, such as $NF_3$, $BF_3$, $CF_4$, HF, $SF_6$, $C_2F_6$, $WF_6$, $CHF_3$, or $SiF_4$. The gases are used independently or in combination. Alternatively, fluorine compound gas with F in its molecular structure can be used as the above-mentioned fluorine- or fluoride-containing gas. Also $F_2$ gas formed by cracking fluorine compound gas in a heat decomposition device and preliminarily formed $F_2$ gas are employed as the above-mentioned fluorine-or fluoride-containing gas. Such fluorine compound gas and $F_2$, gas are mixed for use as needed. The above-mentioned fluorine- or fluoride-containing gas such as fluorine compound gas add $F_2$ gas can be used independently, but are generally diluted by inert gas such as $N_2$ gas for the treatment. The concentration of the fluorine- or fluoride-containing gas itself in such diluted gas should amount to, for example, 10,000 to 100,000 ppm, preferably 20,000 to 70,000 ppm, more preferably 30,000 to 50,000 ppm.

The nickel alloy products with their surfaces nitrided and hardened in the invention are provided by holding the non-nitrided nickel alloy products in a heated fluorine- or fluoride-containing gas atmosphere of sufficient concentration, and fluoriding. This is the most characteristic part of the invention. In this case, the nickel alloy products are held with heating at a temperature of, for example, 350° to 600° C. The holding time of the above-mentioned nickel alloy products in fluorine- or fluoride-containing gas atmosphere may be appropriately selected depending on the nickel alloy species, geometry and dimension of the alloy, heating temperature and the like, generally within the range of about ten minutes to scores of minutes. The treatment of nickel alloy products in such fluorine- or fluoride-containing gas atmosphere allows "N" atoms to penetrate into nickel alloy, which was impossible in the past.

Though the mechanism of the penetration has not yet been proven, it can be understood as follows. An oxidized layer of NiO formed on the nickel alloy surface inhibits penetration of "N" atoms for nitrization. Upon holding nickel alloy with the oxidized layer in a fluorine- or fluoride-containing gas atmosphere with heating as mentioned above, the oxidized layer of NiO is converted to a fluorinated layer of $NiF_2$. "N" atoms for nitrization penetrate more readily into the fluorinated layer of $NiF_2$ than into the oxidized layer of NiO, that is, a nickel alloy surface is formed which is in a suitable condition for the penetration of "N" atoms by the above-mentioned fluorination. Thus, it is considered that "N" atoms in the nitriding gas penetrate uniformly into nickel alloy to a certain depth when the nickel alloy is held in a nitriding atmosphere with such a suitable surface condition to absorb "N" atoms as follows, resulting the formation of a deep uniform nitriding layer.

Thereafter, as mentioned above, nickel alloy products with suitable surface condition to absorb "N" atoms by fluorination are held with heating in a nitriding atmosphere to nitride. In this case, nitriding gas composing a nitriding atmosphere is a simple gas composed of $NH_3$ only, or a mixed gas composed of $NH_3$, and a carbon source gas (for example, RX gas), for example, a mixed gas composed of $NH_3$, CO, and $CO_2$. Mixture of both gases can be also used. Generally, the above-mentioned simple gas or gas mixture mixed with an inert gas such as $N_2$ is used. As necessary, $H_2$ gas is added to those gases.

In such a nitriding atmosphere, the above-mentioned fluorinated nickel alloy products are held with heating. A heating condition is generally set at a temperature of 500° to 700° C., and treatment time is set within the range of 3 to 6 hours. By this nitriding treatment, a close nitriding layer (consisting of entirely single layer) is formed uniformly on the each surface of the above-mentioned nickel alloy, whereby the surface hardness of nickel alloy products reaches more than Hv=600, generally Hv=800 to 1100 while that of base material thereof is Hv=280 to 380 in Vickers hardness. Thickness of the nitrided hard layer basically depends on the nitriding temperature and time, generally 2 to 50 μm. The temperature below 500° C. causes difficulty in forming a nitrided hard layer, and at the temperature over 700° C., a fluorinated layer is damaged and Ni is easily oxidized thereby resulting in a tendency of uneven nitrided layer formation. Moreover, profile roughness of the nitrided and hardened layer surface decreases, which is a defect in the products.

On the other hand, a sufficient fluorinated layer ordinarily cannot be formed at the fluoriding temperature below 350°. Also the temperature over 600° C. is not appropriate for an industrial process because furnace materials of a muffle furnace can not due to extreme fluoriding reaction. From a viewpoint of forming a nitrided hard layer, it is also preferable that the difference between fluoriding temperature and nitriding temperature is as small as possible. For example, a proper nitriding layer may not be formed by nitriding after fluoriding and cooling once.

The above-mentioned fluoriding and nitriding steps are, for example, taken in a metallic muffle furnace as shown in FIG. 4, that is, the fluoriding treatment is carried out first, and then nitriding treatment is put in practice at the inside of the muffle furnace. In FIG. 4, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a metallic container, 13 a vacuum pump, 14 a noxious substance eliminator, 15, 16, 30, and 31 cylinders, 17 flow meters, and 18 a valve. Nickel alloy products 10 are put in the furnace 1. Then the cylinder 16 is connected to a passage and the products are fluorided by introducing fluorine- or fluoride-containing gas atmosphere such as $NF_3$ through the cylinder 16 with heating. The gas is led through the exhaust pipe 6 by the action of vacuum pump 13 and detoxicated in the noxious substance eliminator 14 before being discharged. And then, the cylinders 15, 30, and 31 are connected with a duct for introducing nitriding gas into the furnace 1 in order to carry out nitriding . After nitriding, the gas is removed via the exhaust pipe 6 and the noxious substance eliminator 14. Through the series of these operations, fluoriding and nitriding treatments are put in practice. Additionally a device in FIG. 5 can be employed instead of one in FIG. 4. This device comprises a fluoriding chamber on the left side and a nitriding chamber on the right side. In the figure, the reference numeral 2' are metallic containers, 3' a heater, 5' an exhaust gas pipe, 6' and 7' open-close covers, 11' a base, 21 a furnace body with adiabatic walls, and 22 a barrier movable up and down. The barrier 22 divides the inner space of the furnace body 21 into two chambers, 23 and 24. The chamber 23 is designed for a fluoriding chamber and 24 is for a nitriding chamber. The reference numeral 25 is a rack comprising two rails on which a metallic container 2' having nickel alloy articles therein can slide back and forth between chamber 23 and 24. The reference numeral 10' are legs of the rack 25. The reference numeral 26 is a gas introducing pipe which leads a fluorine- or fluoride-containing gas into the fluoriding chamber 23, 27 a temperature sensor, and 28 a nitriding gas introducing pipe. High-nickel based heat resistance alloy is desirable as material for the above-mentioned metallic muffle furnace 1 instead of stainless steel material. That is, stainless steel is more easily fluorinated than nickel material with high nickel content, and needs large quantities of expensive fluorine source because of its high temperature for fluoriding and the like.

This device is a continuous treatment system in which the inner temperature of a fluoriding chamber 23 is raised by the heating on nitriding in the nitriding chamber 24, nickel alloy articles are introduced into the fluoriding chamber 23 under that condition to be fluorided. After exhausting the gas in fluoriding chamber 23, the nickel alloy articles together with the metallic container are transferred to the nitriding chamber 24 by opening and shutting the barrier 22. And then, nitriding is carried out under that condition thereby conducting fluoriding and nitriding continuously.

The adoption of $NF_2$ as fluorine- or fluoride-containing gas is suitable in particular for the above-mentioned fluoriding. That is, $NF_3$ is a handy gaseous substance that has no reactivity at the room temperature allowing operations and detoxication of exhaust gas to be easy.

The following modes for carrying out the invention illustrate the invention.

EXAMPLE 1

Figure 1:
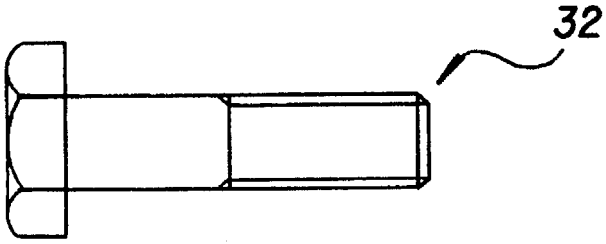
FIG. 1 is a front view of a hexagon headed bolt as an example of nickel alloy products according to the present invention.
Figure 2:
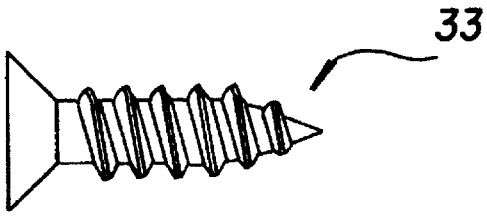
FIG. 2 is a front view of a tapping screw as an example of nickel alloy products according to the present invention.
Figure 3:
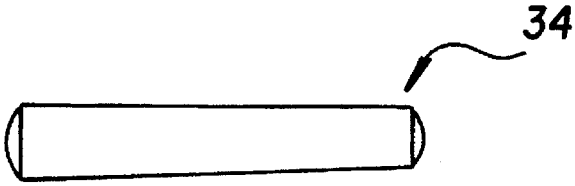
FIG. 3 is a front view of a tapered pin as an example of nickel alloy products according to the present invention, FIG. 4 schematically shows a construction of a treatment furnace for carrying out nitriding according to the present invention, and FIG. 5 schematically shows a construction of another furnace.
Figure 4:
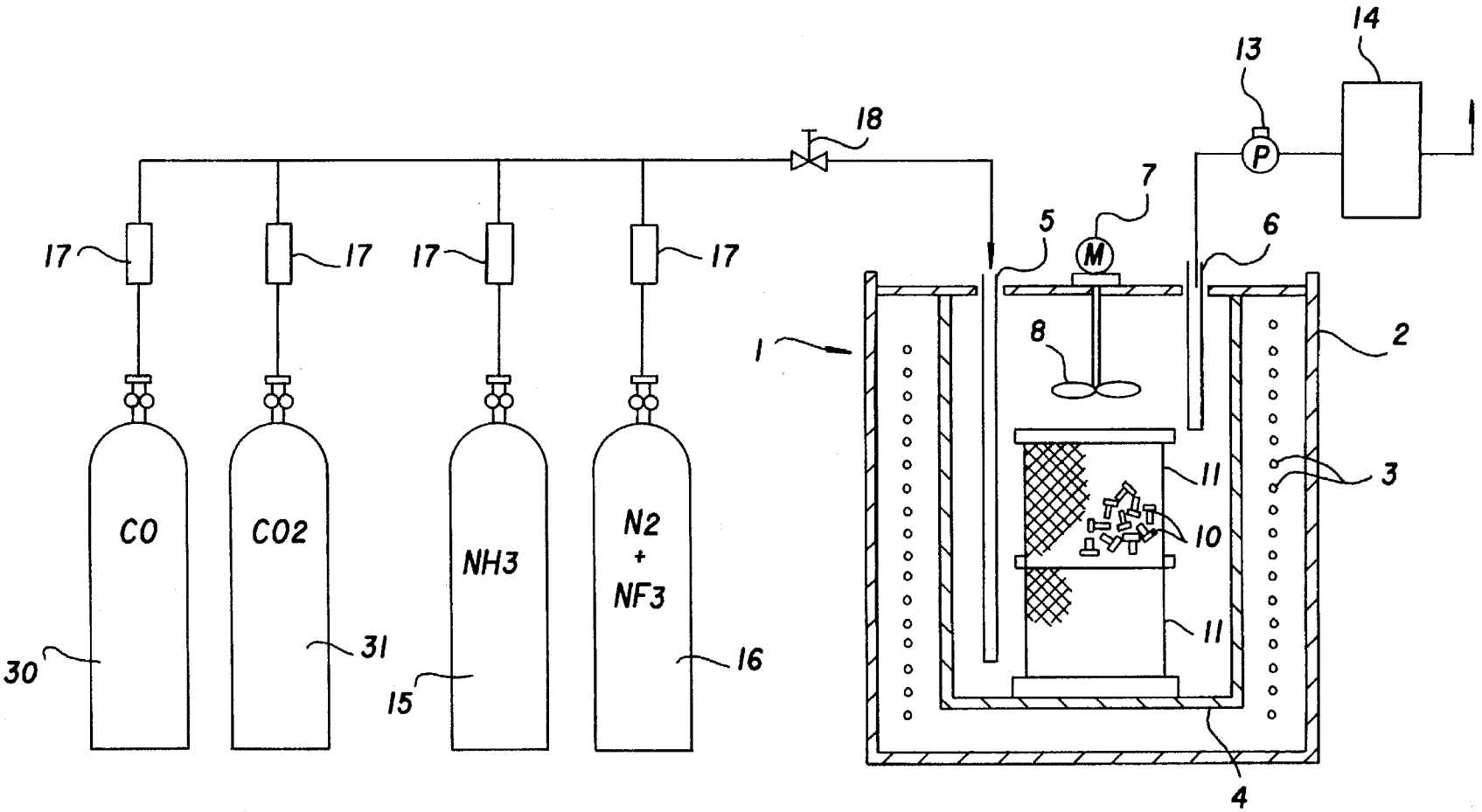
Figure 5:
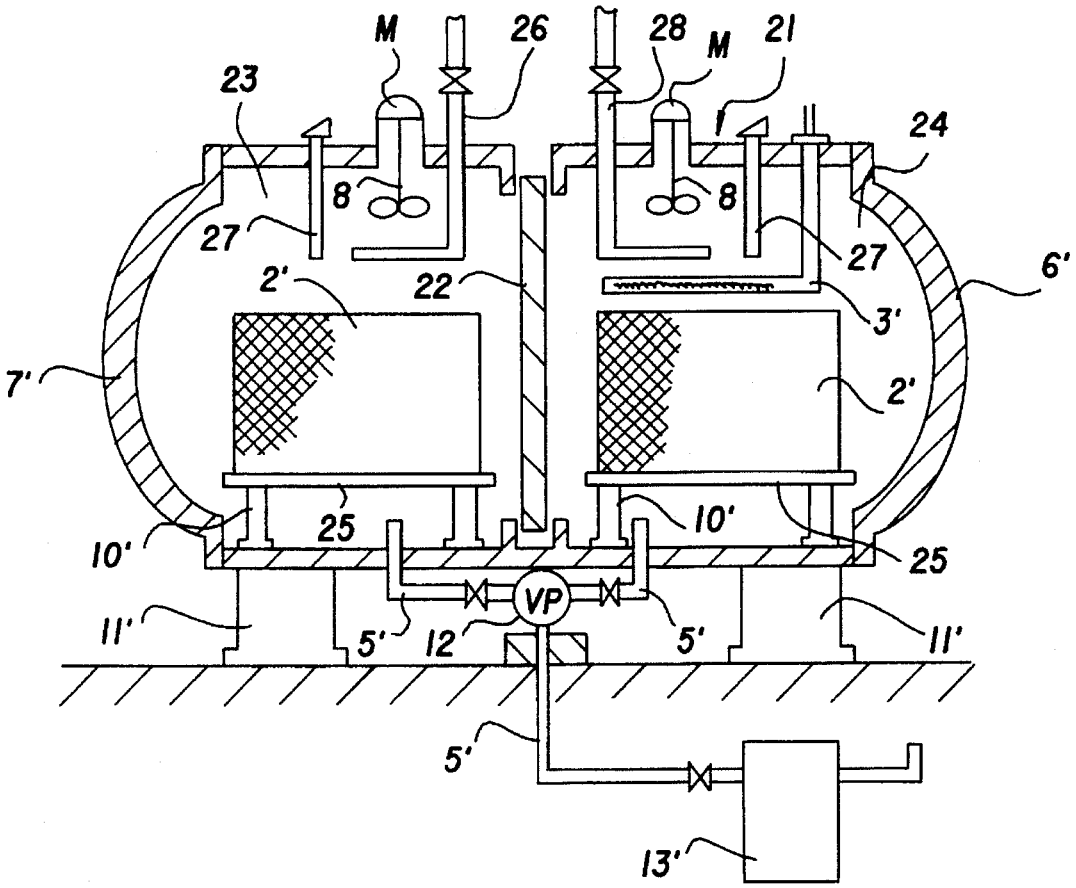

Nickel alloy products such as hexagon headed bolts (M8) shown in FIG. 1, tapping screws shown in FIG. 2, and tapered pins shown in FIG. 3 were prepared by cold casting 61Ni-22Cr-9Mo nickel alloy material, and they were charged into a treatment furnace 1 as shown in FIG. 4. After evacuating the inside of the furnace 1 fully, it was heated to 550° C. Then, in that state, fluorine- or fluoride-containing gas ($NF_3$ 10 Vol %+$N_2$ 90 Vol %) was charged into the furnace and an atmospheric pressure was formed in it and the condition was maintained for 40 minutes. Then after exhausting the above-mentioned fluorine- or fluoride-containing gas from the furnace, nitriding gas ($NH_3$ 50 Vol %+$N_2$ 35 Vol %+Co 10 Vol %+$Co_2$ 5 Vol %) was introduced into the furnace and the inside of the furnace was heated to 550° C. Nickel alloy products were nitrided by being held in this condition for 3 hours and then taken out.

Through this nitriding process, surface hardness of the above-mentioned nickel alloy products reached from Hv=850~900 in Vickers hardness. Uniform nitrided and hardened layers were formed in the whole surfaces of the nickel alloy products and their thickness of nitrided and hardened layers was 25 μm. Also those samples were submitted to salt spray tests according to JIS, and no rust occured even after 720 hours. Moreover, for tapping screws, screw tests using SPCC iron plates, which have 2.3 mm thickness, were carried according to JIS, and it was found that internal threads were formed in the SPCC plates showing good tapping property without breaking the screw threads.

EXAMPLE 2

Drilling screws and cap screws formed by pressure casting 61Ni-23Cr-14Fe nickel alloy material were charged into a treatment furnace 1 as shown in FIG. 4. After vacuum purging the inside of the furnace 1 fully, it was heated to 550° C. Then, in that state, fluorine- or fluoride-containing gas ($NF_3$ 10 Vol %+$N_2$ 90 Vol %) was charged into the furnace and all atmospheric pressure was formed in it and the condition was maintained for 40 minutes. Then after exhausting the above-mentioned fluorine- or fluoride-containing gas out of the furnace, nitriding gas ($NH_3$ 50 Vol %+$N_2$ 35 Vol %+Co 10 Vol %+$Co_2$ 5 Vol %) was introduced into the furnace and the inside of the furnace was heated to 600° C. Nitriding treatment was carried out in this condition for 7 hours.

Through this nitriding process, surface hardness of the above-mentioned nickel alloy products reached from Hv=950~1000 in Vickers hardness while core hardness was Hv=310~320. Uniform nitrided and hardened layers were formed in the whole surfaces of the nickel alloy products and their thickness of nitrided and hardened layers was 35 μm. Also, for drilling screws among the above-mentioned nitrided nickel alloy products, drilling tests were carried out using SPCC plates with 1.6 mm thickness, Ti plates with 1.2 mm thickness, and SUS plates with 1.0 mm thickness. As a result, time taken for screwing the SPCC plates with load of 15 kg was 2.4 seconds, which is about the same drilling time as that of iron products. For the Ti plates and SUS plates, about the same level of drilling property was obtained as that of SPCC plates.

EXAMPLE 3

Hexagon headed bolts (M8) shown in FIG. 1 and tapping screws shown in FIG. 2 formed by pressure casting 61Ni-23Cr-14Fe nickel alloy material were charged into a treatment furnace 1 as shown in FIG. 4. After evacuting the inside of the furnace 1 fully, it was heated to 350° C. Then, in that state, fluorine- or fluoride-containing gas ($F_2$ 10 Vol %+ $N_2$ 90 Vol %) was charged into the furnace to form an atmospheric pressure in it and the condition was maintained for 40 minutes. Then after exhausting the above-mentioned fluorine- or fluoride-containing gas out of the furnace, nitriding gas ($NH_3$ 50 Vol %+$N_2$ 35 Vol %+Co 10 Vol %+$Co_2$ 5 Vol %) was introduced into the furnace and the inside of the furnace was heated to 500° C. Nitriding treatment was carried out in this condition for 5 hours.

Through this nitriding process, surface hardness of the above-mentioned nickel alloy products reached from Hv=850 to 900 in Vickers hardness. Although thickness of nitrided and hardened layers had some unevenness (partly 2 to 3 μm), maximum thickness was 10 μm. Also those samples were submitted to salt spray tests according to JIS, and no rust occured even after 720 hours.

EXAMPLE 4

Hexagon headed bolts (M8) shown in FIG. 1 formed by pressure casting 61Ni-22Cr-9Fe were charged into a treatment furnace 1 as shown in FIG. 4. After evacuating the inside of the furnace 1 fully, it was heated to 400° C. Then, in that state, fluorine- or fluoride-containing gas ($F_2$ 10 Vol %+ $N_2$ 90 Vol %) was charged into the furnace to form an atmospheric pressure in it and the condition was maintained for 40 minutes. Then after exhausting the above-mentioned fluorine- or fluoride-containing gas out of the furnace, nitriding gas ($NH_3$ 50 Vol %+RX 50 Vol %) was introduced into the furnace and the inside of the furnace was heated to 700° C. Nitriding treatment was carried out in this condition for 5 hours.

Through this nitriding process, surface hardness of the above-mentioned nickel alloy products reached from Hv=700 to 750 in Vickers hardness while core hardness was Hv=340. Maximum thickness of nitrided and hardened layers was 40 μm. Also, unevenness of about 10 μm in the hardened layers of the screw thread parts and the bottoms of the threads was observed. Also those samples were submitted to salt spray tests according to JIS, and no corrosion occured even after 720 hours.

EFFECT OF THE INVENTION

As mentioned hereinbefore, nickel alloy products with their surfaces nitrided and hardened in the present invention have surface layers formed as nitrided and hardened layers. The invention comprises converting films of the surfaces of the nickel alloy products to fluorided layers, and forming the surface layers into nitrided and hardened layers by conducting nitriding treatment. Generally, nickel alloy material includes elements such as Cr and Mo that can easily form hard intermetallic compounds such as CrNi and MoNi by reacting with "N" atoms. Since "N" atoms can penetrate the previously formed fluorided layers even at the time of nitriding, "N" atoms penetrate uniformly into the surface layers of the nickel alloy products to the certain depth when nitriding. As a result, it become possible to form the close uniform nitrided and hardened layers only in their surface layers at the certain depth resulting drastic improvement of surface hardness without raising the base material stiffness of the nickel alloy products. Therefore, since the nitrided and hardened surfaces of the nickel alloy products according to the present invention have much better corrosion resistance than iron products have in corrosion surroundings, anticorrosion treatment such as plating is not required, and rich lubricity and excellent tightening property can be obtained without having seizure and scuffing phenomena.

What are claimed are:

1. A process of producing a hardened nickel alloy article comprising:

providing a nickel alloy article;

forming a fluoride layer on a surface of the nickel alloy article; and transforming the fluoride layer into a nitride layer on the nickel alloy article.

2. A process according to claim 1, wherein the nickel alloy contains more than 25 wt % Ni and not more than 50 wt % Fe.

3. A process according to claim 2 wherein the nickel alloy contains 25–82 wt % Ni, 6–48 wt. % Fe, and at least one element selected from the group consisting of Cr and Mo in an amount of 3–20 wt. %.

4. A process according to claim 3, wherein the nickel alloy article is in the form of a bolt, rivet, nut, pipe thread plug, washer, pin, turnbuckle, shackle, pipe swagelock, or screw.

5. A process according to claim 1 wherein the hardened nickel alloy article comprises a nickel alloy having a hardness of 280 to 380 Hv and the nitride layer havs a hardness of 800–1100 Hv.

6. A process according to claim 5, wherein the nickel alloy contains more than 25 wt % Ni and not more than 50 wt % Fe.

7. A process according to claim 6, wherein the nickel alloy contains 25–82 wt. % Ni, 6–48 wt. % Fe, and at least one element selected from the group consisting of Cr and Mo in an amount of 3–20 wt. %.

8. A process according to claim 7, wherein the nickel alloy article is in the form of a bolt, rivet, nut, pipe thread plug, washer, pin, turnbuckle, shackle, pipe swagelock, or screw.

9. A process of producing a hardened nickel alloy article comprising:

pressure casting a nickel alloy to form a nickel alloy article;

forming a fluoride layer on the nickel alloy article; and transforming the fluoride layer to a nitride layer on the nickel alloy article.

10. A process according to claim 9, wherein the nickel alloy contains more than 25 wt % Ni and not more than 50 wt % Fe.

11. A process according to claim 10, wherein the nickel alloy contains 25–82 wt % Ni, 6–48 wt. % Fe, and at least one element selected from the group consisting of Cr and Mo in an amount of 3–20 wt. %.

12. A process according to claim 11, wherein the nickel alloy article is in the form of a bolt, rivet, nut, pipe thread plug, washer, pin, turnbuckle, shackle, pipe swagelock, or screw.

13. A process according to claim 9, wherein the hardened nickel alloy article comprises a nickel alloy having a hardness of 280 to 380 Hv and the nitride layer has a hardness of 800–1100 Hv.

14. A process according to claim 13, wherein the nickel alloy contains more than 25 wt % Ni and not more than 50 wt % Fe.

15. A process according to claim 14, wherein the nickel alloy contains 25–82 wt % Ni, 6–48 wt. % Fe, and at least one element selected from the group consisting of Cr and Mo in an amount of 3–20 wt. %.

16. A process according to claim 15, wherein the nickel alloy article is in the form of a bolt, rivet, nut, pipe thread plug, washer, pin, turnbuckle, shackle, pipe swagelock, or screw.

* * * * *